US008816812B2

(12) United States Patent
Koprivsek

(10) Patent No.: US 8,816,812 B2
(45) Date of Patent: Aug. 26, 2014

(54) VARISTOR FUSE ELEMENT

(75) Inventor: Mitja Koprivsek, Izlake (SI)

(73) Assignee: ETI Elektroelement d.d., Izlake (SI)

( * ) Notice: Subject to any disclaimer, the term of this patent is extended or adjusted under 35 U.S.C. 154(b) by 41 days.

(21) Appl. No.: 13/816,827

(22) PCT Filed: Jun. 2, 2011

(86) PCT No.: PCT/SI2011/000030
§ 371 (c)(1),
(2), (4) Date: Apr. 4, 2013

(87) PCT Pub. No.: WO2012/026888
PCT Pub. Date: Mar. 1, 2012

(65) Prior Publication Data

US 2013/0200986 A1 Aug. 8, 2013

(30) Foreign Application Priority Data

Aug. 26, 2010 (SI) ..... P-201000257

(51) Int. Cl.
*H01C 7/10* (2006.01)
*H01C 7/13* (2006.01)
*H01C 7/12* (2006.01)

(52) U.S. Cl.
CPC . *H01C 7/126* (2013.01); *H01C 7/10* (2013.01)
USPC ..... 338/21; 338/20; 361/117

(58) Field of Classification Search
USPC ..... 338/20, 21
See application file for complete search history.

(56) References Cited

U.S. PATENT DOCUMENTS

| | | | | |
|---|---|---|---|---|
| 4,064,475 | A * | 12/1977 | Kouchich et al. | 338/20 |
| 4,638,284 | A * | 1/1987 | Levinson | 338/21 |
| 5,596,308 | A * | 1/1997 | Bock | 338/20 |
| 6,185,813 | B1 * | 2/2001 | Donnola | 29/613 |
| 6,211,770 | B1 * | 4/2001 | Coyle | 338/21 |

FOREIGN PATENT DOCUMENTS

| | | | |
|---|---|---|---|
| FR | 2 629 263 | A1 | 9/1989 |
| FR | 2629263 | A1 | 9/1989 |
| WO | WO 2004/072992 | A1 | 8/2004 |

OTHER PUBLICATIONS

Written Opinion of the International Searching Authority/European Patent Office, for PCT/SI2011/000030, mailed.
Mar. 7, 2013 Notification, International Preliminary Report on Patentability, and Written Opinion of the International Searching Authority/EPO for PCT/SI2011/000030.

* cited by examiner

*Primary Examiner* — Kyung Lee
(74) *Attorney, Agent, or Firm* — William B. Nash; Joe Mencher; Haynes & Boone, LLP

(57) ABSTRACT

The purpose of the invention is to create such a varistor fuse element, which should within a single housing include both a varistor (1) as well as an electric fuse (2), wherein said varistor part i.e. a varistor (1) is intended to protect each electric installation against overvoltage impulses and consequently against current strokes, while the fuse (2) is capable to transmit the current stroke due to increased voltage and to interrupt each permanently increased electric current, which might occur due to defects on the varistor (1). Moreover, such varistor fuse should not exceed dimensions of already known and widely used protective means, in particular melting fuses. In accordance with the invention, the fuse (2) with its round tubular casing (20) and the varistor, which is also embedded within a round tubular casing (10), are serial interconnected and arranged coaxially within each other.

18 Claims, 1 Drawing Sheet

VARISTOR FUSE ELEMENT

CROSS-REFERENCE TO RELATED APPLICATION

This application is a United States national phase application of co-pending international patent application number PCT/SI2011/000030, filed Jun. 2, 2011, which claims the benefit of Slovenia Application No. P-201000257 filed Aug. 26, 2010, of which is hereby incorporated by reference in its entirety.

BACKGROUND

The invention refers so a varistor fuse element, which comprises at least a varistor and a melting member and can be integrated into each appropriate DC or AC electric circuit.

According to the International Patent Classification, such inventions belong to electricity, namely to basic electric elements, in particular to overvoltage protection components on the basis of varistors. Furthermore, such invention may also belong to emergency protective circuit arrangements, which are adapted to interrupt the circuit automatically, as soon as undesired deviations with respect to usual operating conditions occur and/or when transient voltage occurs.

The invention is rest on the problem how to arrange a varistor fuse element comprising a combination of a varistor and a melting member that in a simple manner and when possible without introducing additional parts, components and wirings an efficient overvoltage protection will be maintained despite to possible variations of resistance if/whenever these would occur.

Consequently, the purpose of the invention is to create such a fuse, which should in a single and uniform casing comprise a varistor part, which should be capable to protect electric installations against overvoltage impulses and current strokes, as well as an electric fuse, which should be capable to transmit the current stroke due to increased voltage and to interrupt the circuit in the case of permanently increased current, which might occur due to damages in the varistor part. At the same time, such fuse element be available in the form of commonly used protective appliances, in particular electric melting fuses, and should not exceed dimensions thereof.

A varistor fuse element is one of protective appliances, which are intended for integration into electric circuits, in particular such circuits in which the probability of generating transient or transitional voltage due to direct or indirect lightning strike into particular building or its surrounding is pretty high. Such varistor fuse element may be used both in AC or DC installations, and also in electric installations used in exploitation of renewable energy resources, for example in photovoltaic power plants.

Protection against overvoltage, namely protection against short-term overvoltage impulses, is generally known to those skilled in the art and is a standard part in a sequence of protective measures in low-voltage electric installations. Namely, a voltage-depending resistance, the so-called varistor is usually used for such purposes. Varistors are usually manufactured in the form of plates consisting of a special sintered material, e.g. of zinc oxide (ZnO). Thanks to their properties, in normal circumstances the resistance thereof is very high. When exposed to an overvoltage impulse, e.g. due to a lightning strike, the resistance of such varistor is essentially decreasing, and the undesired overvoltage stroke is transmitted to the earth. Upon that, the resistance is increasing again towards the range of electric insulators.

As known, upon several successive current strokes through the varistor problems may occur in regard of changing the resistance of the varistor. By such changing, certain lower currents may be generated within the resistor even by nominal voltage. Such currents lead to overheating of the resistor, which results in further damages within the resistor, until it becomes completely out of order. Of that reason the varistor is normally serial connected with a thermal switch, which is able to operate in such a manner that by to high temperature on the body of the varistor the last is separated out from the circuit. Such thermal switch is usually manufactured in the form of resilient strip, which is soldered onto the varistor body. As soon as the body is then overheated due to current conducted by the nominal voltage, the solder is molten and the circuit is then interrupted by means of such switch. The main deficiency of such switch is the arc, which may occur in such switch and cannot be managed by the switch, which may be quite dangerous in photovoltaic (PV) installations. In such cases the explosion may occur in the switch, by which a part of installation may be damaged or at risk. The situation with said PV installations is in particular problematic because the parallel arc cannot be extinguished until the panel is exposed to the light. Said problem is not just a hypothetic one, and the users have complained that at present available overvoltage protection in PV installations is definitively bound with such problems.

Several approaches in the course of resolving such problems are known in the prior art. The fist possibility is given by the so-called SRF fuse (Surge Rated Fuse), which is serial connected to the varistor and is merely dealing with the question of essentially decreased resistance, through which a short circuit may occur at the nominal voltage. However, the melting threshold of such SRF fuse must be pre-determined at sufficiently high level since otherwise the fuse would be molten whenever the current stroke would occur. Consequently, the fuse is declared with regard to each value kA of impulse, which may still be conducted through such SRF fuse. The main deficiency of such approach results in two separate parts within two separate casings, namely a varistor within its casing and serial SRF fuse in its casing or stand, which have to be integrated installation. Such approach then requires much more space and wirings, which is undesired.

A further approach is described in WO2008/69870 (Ferraz Shawmut). In this case, the varistor is serial interconnected with a thermal switch, which is parallel interconnected with a fuse. A resilient strip of the thermal switch is soldered onto the varistor. When by too high temperature of the varistor the switch is activated, the current is redirected towards the fuse, in which the melting member is then molten, and the arc is herewith extinguished. Such appliance consists of three parts, which is a main deficiency, and moreover, two processes are successively performed, wherein in the first step the solder is molten on the contact of the switch, by which the switch is activated, and upon that in the second step the melting member within the fuse must be molten.

A still further approach is described in WO2004/072992 where the tubular varistor is foreseen, which simultaneously serves as a casing for a fuse having a melting member. However, when the overvoltage occurs, the casing of such fuse cannot serve as a resistance anymore, since the varistor becomes conductive at least for a short time period, so that the melting member of such fuse is then unable to perform correctly the main function thereof. Of that reason, at least according to the knowledge of the present inventor, this solution has never been practically applied.

It is moreover known to those skilled in the art that a so-called M-effect is performed for the purposes of interrupting each melting member whenever to high current has occurred, which might lead to overloading of installations. Such effect is based on the fact that the melting temperature of a copper-tin alloy is lower than the melting temperature of each of these metals as such. From quite construction point of view, melting members in fuses are manufactured in such a manner that the tin in the form of solder is placed on a copper melting member adjacent to a weak portion which is also foreseen on such melting member. When exposed to sufficiently high current, the temperature of the weak portion is increased, which leads to melting of tin within the solder, wherein said copper-tin alloy has not only a lower melting temperature but also higher electric resistance. Consequently, the resistance of the melting member in the area of said weak portion is increased, which leads to still further heating of the solder and still more intensive producing the copper-tin alloy. The whole process is developed quickly up to interruption of the melting member in the area of said weak portion. Operation of melting fuses and melting members is described in literature relating to operation and exploitation of such fuses.

SUMMARY

The invention refers to a varistor fuse element, comprising a cylindrical varistor, the resistance of which depends on voltage, as well as a cylindrical fuse, which are serial electric connected to each other. Said varistor consists of a pair of electric conductive electrodes, which are separated from each other by means of a body consisting of a material having a resistance which is depending on electric voltage, while said fuse consists of an electric insulating body, which is furnished with contact means which consist of an electric conductive material and are located on the end portions thereof and connected to each other by means of a melting member, which consists of electric conductive material and is furnished with a weak portion having a pre-determined cross-section which is adjusted for the purpose of melting and interrupting the contact between said contact means when the fuse is electrically overloaded.

In this case the invention provides that the fuse comprising a round tubular body and a varistor also comprising round tubular body are inserted within each other in such a manner that the varistor is placed within a longitudinal passage in the body of the fuse which is filled with the arc extinguishing material, and that electric conductive contact means are available on the end portions of said fuse body, wherein the electrode on the external surface of the varistor is electrically interconnected with one contact means of the fuse, while the other contact means thereof is via the melting member electrically interconnected with the other electrode of the varistor, which is available on the internal surface of the body of said varistor.

Another aspect of the invention refers to a varistor fuse element, comprising a cylindrical varistor, having the resistance which depends on voltage, as well as a cylindrical fuse, which are electric interconnected in a serial manner, wherein said varistor consists of a pair of electric conductive electrodes, which are separated from each other by a body consisting of a material having a resistance which is depending on electric voltage, and wherein said fuse consists of an electric insulating body, which is furnished with electric conductive contact means which are located on the end portions thereof and are connected to each other by means of a melting member, which consists of electric conductive material and comprises a weak portion having a pre-determined cross-section which is adjusted for the purposes of melting and interrupting the contact between said contact means when the fuse is electrically overloaded.

In this case the invention provides that the fuse comprising a round tubular body and the varistor also comprising a round tubular body are inserted within each other, so that the fuse is inserted within a longitudinal passage in the round tubular body of said varistor comprising the first electrode placed on the external surface and at least partially on one of the front surface thereof, while the second electrode of the varistor is located on the internal surface of said varistor body, wherein said fuse is exposed to the heat generated within the varistor due to varying the resistance thereof and comprises a longitudinal passage which is filled with an arc extinguishing material as well as melting member which extends throughout said passage and by means of which two contact means arranged on the end portions of the fuse are connected to each other indirectly via appropriate solder, and wherein the first contact means of the fuse is arranged within said passage in the body of the varistor and is electrically interconnected with the electrode on the internal surface of the body of the varistor, while the second contact means is arranged outside of the passage of the body of the varistor and is included in the electric circuit together with the other electrode located on the external surface and/or the front surface of the body of the varistor.

Said melting member comprises at least one weak portion having a pre-determined transversal cross-section.

In accordance with the first aspect of the invention, the melting member is via the solder electrically connected to the second electrode of the varistor, which is located on the internal surface of the body of the varistor. The weak portion on the melting member is preferably located adjacent to the solder. Moreover, said second electrode of the varistor and the melting member are both interconnected i.e. coated with the colder until the last is molten. The melting member is preferably pre-tensioned prior to coating thereof by solder and has a tendency of deflecting apart from the electrode of the varistor.

In general, the invention also provides that the melting temperature of the solder is lower than the melting temperatures of materials of the melting member and of the electrode of the varistor cooperating therewith. The material of the solder is preferably defined in such a manner that the resistance thereof is increasing by increasing the temperature. Moreover, the arc extinguishing material, which is present within the passage of the fuse and preferably also within the passage of the varistor, is preferably silica.

BRIEF DESCRIPTION OF THE DRAWINGS

The invention is described in more detail on the basis of two embodiments, which are shown in the attached drawing, wherein.

DETAILED DESCRIPTION

Figure 2:
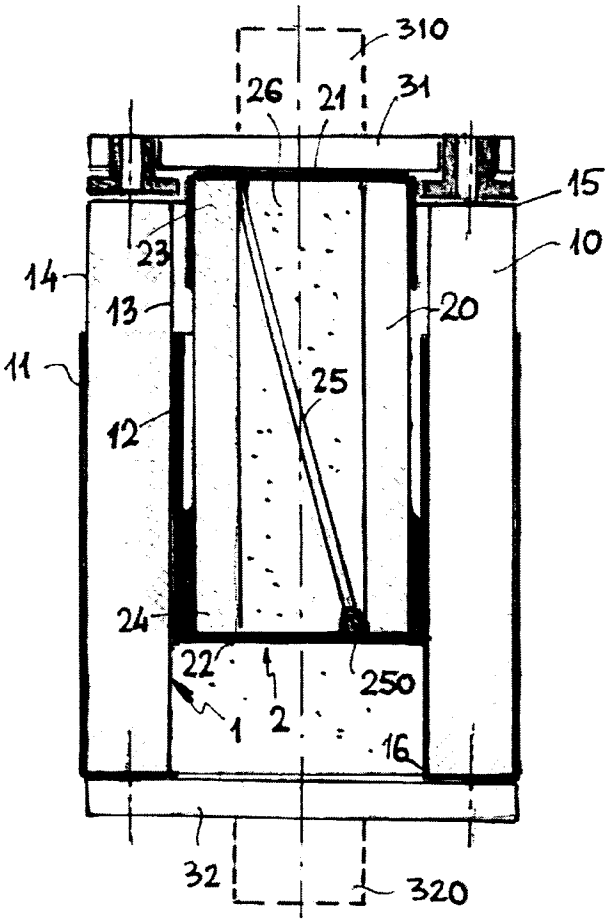
FIG. 2 is a longitudinal cross-section through the second embodiment.

The object of the invention is a construction concept of product, by which the previously exposed problem has been resolved. The proposed solution is based on a cylindrical fuse 2 and a varistor 1 in the form of a cylindrical tube. Two embodiments of will be described. In both embodiments, said fuse 2 and said varistor are arranged coaxially within each other, wherein in the first embodiment according to FIG. 1 the varistor 1 is placed within the passage of a round tubular body 20 of the fuse 2, while in the second embodiment on the contrary the fuse 2 is inserted within a passage in a round tubular body 10 of the varistor. In this, the term "round tubular" body 10 of the varistor 1 or "round tubular" body 20 of the fuse 2 means a body in the form of a round tube, namely of a tube having a round transversal cross-section.

Said round tubular body 10 of the varistor consists of a material (e.g. of ZnO) by which the conductivity is depending on contact voltage, so that such material may be used as insulator up to a pre-determined value of voltage. As soon as the voltage has overcome such pre-determined value, depending on thickness and configuration, the conductivity is essentially increased, by which the current stroke due to the increased voltage is discharged via the earth connection. In addition to that, due to such cylindrical shape of said body 10 in comparison with commonly used plate-like varistor 1 the complete fuse element as a commercial product is then available in a much more compact form.

As known to those skilled in the art, said tubular body 2 of the fuse 2 consists of an insulating material, preferably of ceramics or a plastic composite. Two contact means 21, 22 are placed on the end portions 23, 24 of the body 20 and are electrically interconnected via a melting member 25.

Figure 1:
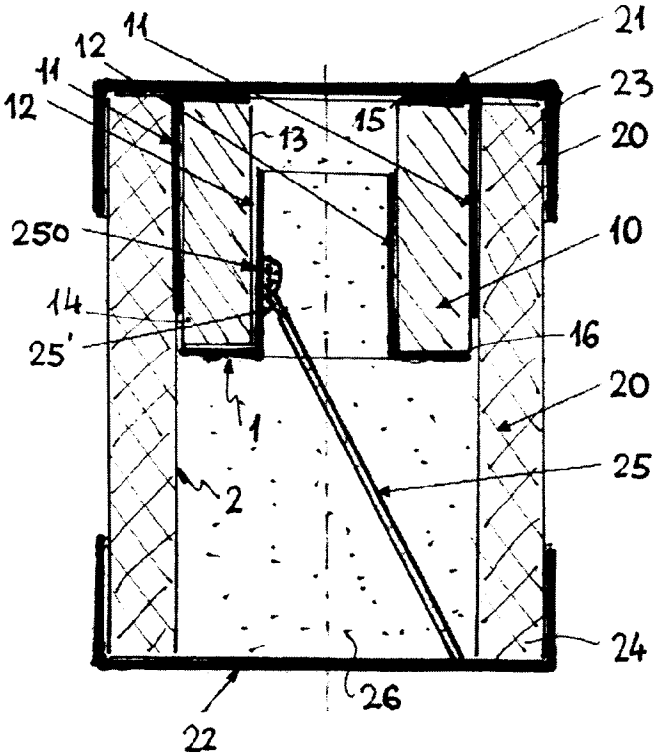
FIG. 1 is a longitudinal cross-section through the first embodiment.

The first embodiment according to FIG. 1 is based on a cylindrical fuse 2 having a sufficiently wide internal diameter of the tubular body 20. (i.e. at least Type CH 22 or larger). In such case, the varistor 1 is manufactured as a cylinder, which is then inserted into a passage of the tubular body 20 of the fuse 2. A cylindrical varistor 1 is manufactured in such a manner that both electrodes 11, 12, which are separated from each other by means of said body 10 of the varistor 1, are available in the form of silver layers on the external surface 14 and the internal surface 13 of said body 10, wherein the outer electrode 11 is electrically interconnected with the adjacent first contact means 21 of the fuse 2, which is in this particular case performed in the area of one of both front surfaces 15, 16 of the body 10, while the melting member 25 of the fuse 2 is in this particular case attached to the internal electrode 12 of the varistor 1 by means of a solder 250 and is moreover electrically interconnected with the second contact means 22 of the fuse 2. Said melting member 25 of the fuse 2 preferably consists of copper and extends throughout the passage in the tubular body 20 of the fuse 2, which should be normally filled with an arc extinguishing material 26, in particular with sand on the basis of silica, which is capable to eliminate arc, which might occur when the melting member 25 is interrupted. Said solder 250 preferably consists of an alloy on the basis of copper and tin.

The melting member 25 is conceived in such a manner that the first weak portion 25' is located quite in the initial area adjacent to the solder 250 i.e. adjacent to the location of soldering to the electrode 12 of the varistor. Such, the solder 250 is simultaneously used on the one hand for the purposes of establishing of an electric conductive interconnection between the melting member 25 and the electrode 12 of the varistor, and on the other hand also for performing a so-called M-effect, which is required for the purposes of interrupting the melting member 25 in the case of overloading, or by low currents, respectively. The area, in which the solder 250 is applied, is arranged in such a manner that the melting member 25 as such is not in contact with the internal electrode 12 of the varistor 1 which is located on the internal surface 13 of the body 10, and prior to applying the solder 250, the melting member 25 is located at certain gap apart from said electrode 12 of the varistor, which gap is then filled with the solder 250. As soon as the solder 250 is molten, the liquid solder flows out from said gap between the melting member 25 and the electrode 12 of the varistor 1 towards the arc extinguishing material 26, namely into pores between silica particles. In fact, two processes of interrupting the contact between the melting member 25 and the electrode 12 are actually available and applied simultaneously or separately, depending on each particular conditions related to electric current and temperature. The rest of the melting member 25 outside of said weak portion 25' is conceived in such a manner that the electric circuit throughout the fuse 2 is interrupted as soon as a short-circuit occurs, or when the current is essentially increased. Besides, the melting integral thereof must be sufficiently high, so that quite similarly like in a so-called SRF-fuse, the current stroke of nominal range in kA should not initiate melting of the melting member 25 and interrupt protective effect during the period of such impulse.

In this particular case, the complete interior of the fuse 2 and also of the varistor 2 is filled with silica, which is used as the material 26 for extinguishing the arc, which might be generated by when the melting member 25 is interrupted.

In accordance with a further aspect of the invention, the melting member 25 is mounted within the fuse 2 in a pre-tensioned state, by which upon melting it is then automatically deflected away from the corresponding electrode 12 of the varistor, so that efficiency and reliability of such varistor fuse element according to invention may be still additionally improved.

Whenever an overvoltage impulse occurs, conductivity of the varistor 1 is essentially increasing, so that the current is able to pass the body 10 between the electrodes 11, 12 radially and then via the melting member 25, which is however not melting in such situation. Such stroke i.e. overvoltage is then lead to the earth connection.

Whenever the varistor 1 is disabled or at least partially damaged, conductivity of the varistor is always increasing, although the overvoltage does not occur at all. Depending on the current intensity, the following possibilities may occur:

- Whenever a low current of several mA up to approximately 1A is passing through the varistor 1, the body 10 of the varistor starts overheating, and the solder 250 between the varistor 1 and the melting member 25 starts melting, by which the contact between the electrode 12 of the varistor 1 and the melting member 25 of the fuse 2 is interrupted;
- whenever the medium current within the range between approx. 1 A and approx. 10A is passing through the varistor 1, said M-effect occurs in the first weak portion 25' of the melting member 25, by which the heat is generated both in said weak portion 25' and in the varistor 25, and interruption is then performed much earlier than in situation without overheating of the varistor 1;
- whenever the current within the range between several hundred A and several kA is passing the varistor 1, the varistor 1 as such cannot represent a high resistance, while the melting member 25 is held in a short-circuit and is molten across the complete cross-section within a quite short interruption period of several ms.

In all three above situations, interruption of the path of the current occurs within the passage in the body 20 of the fuse 2 and therefore in the area where the arc extinguishing material 26 i.e. the silica is present, so that the arc is rapidly extinguished. The fact that the arc can never occur outside of the fuse 2 is apparently an essential benefit in comparison with known solutions, and may simultaneously with a compact construction and combining the fuse 2 with a thermal switch lead to achieving much higher interrupting efficiency of the fuse 2.

Another embodiment according to FIG. 2 is based on a cylindrical varistor 1, wherein the fuse 2, e.g. a cylindrical SRF fuse, is embedded within the passage and where the thickness of the wall of the body 10 is determined with regard to each expected level of the voltage. Functioning of the varistor 1 is performed radially through the active body 10 between both electrodes 11, 12, and the fuse 2 is serial interconnected with the varistor 1. Also in this case the varistor 1 and the fuse 2 are arranged coaxially within each other, wherein the fuse 2 is placed within the passage extending throughout the varistor 1. However, in this case the serial interconnection of the varistor 1 and the fuse 2 is much more conventional. Namely, the melting member 25 is not soldered directly to the electrode 12 like in the first embodiment, and the complete fuse 2 is inserted within the cylindrical varistor 1. Said M-effect occurs on the melting member 25 in a classic manner like in any other fuse 2. Whenever the varistor 1 is damaged, the heat generated by such damaged varistor 1 is then via both contact means 21, 22 and the body 20 of the fuse 2 transferred to the melting member 25.

In this case, the fuse 2 and the varistor 1, which are inserted within each other, are embedded between contact plates 31, 32, which are furnished with contact protrusions 310, 320, which are adapted for inserting into not-shown seats for receiving the fuse 2. The external electrode 11 of the varistor 1 is maintained in the electricity conducting contact with the contact plate 32 on the front surface 16, while the contact 21 means 21 of the fuse 2 is maintained in the electricity conducting contact with the other contact plate 31. Electric current between the contact plates 31, 32 is therefore able to pass through the fuse 2 and through the varistor 1 which is serial interconnected therewith, namely through the contact plate 32 and then through the external electrode 11 as well as the body 10 towards the internal electrode 11 of the varistor 1, and then via the contact means 22 and the melting member 25, which is by means of the solder 250 connected thereto, towards the other contact means 21 of the fuse and then through the other contact plate 31.

The invention claimed is:

1. A varistor fuse element, comprising:

a cylindrical fuse including an electrically insulating fuse body that defines a longitudinal passage, wherein first and second electrically conductive fuse contacts are located on opposite ends of the fuse body, and wherein the longitudinal passage includes an arc extinguishing material;

a cylindrical varistor that is located in the longitudinal passage, that includes a varistor body having a resistance that is dependent on voltage, and that is serially electrically connected to the fuse with an electrically conductive first varistor electrode located on an external surface of the varistor body and electrically connected to the first fuse contact, and an electrically conductive second varistor electrode located on an internal surface of the varistor body such that the first and second varistor electrodes are separated by the varistor body; and an electrically conductive melting member connecting the second fuse contact and the second varistor electrode in order to connect the first and second fuse contacts, wherein the melting member includes a weak portion having a pre-determined cross-section that is operable to melt and interrupt the connection between the first and second fuse contacts when the fuse is electrically overloaded.

2. The varistor fuse element of claim 1, wherein the weak portion of the melting member comprises a pre-determined transversal cross-section.

3. The varistor fuse element of claim 2, wherein a solder electrically connects the melting member to second varistor electrode.

4. The varistor fuse element of claim 3, wherein the weak portion of the melting member is located adjacent to the solder.

5. The varistor fuse element of 4, wherein the second varistor electrode is connected to the melting member by the solder until the solder melts.

6. The varistor fuse element of claim 5, wherein the melting member is pre-tensioned prior to connection to second varistor electrode by the solder such that the melting member is operable to deflect away from the second varistor electrode when the solder melts.

7. The varistor fuse element of claim 3, wherein the melting temperature of the solder is lower than a melting temperature of the melting member and a melting temperature of the second varistor electrode.

8. The varistor fuse element of claim 3, wherein the solder includes a resistance that increases in response to increasing temperature.

9. The varistor fuse element of claim 1, wherein the arc extinguishing material includes silica.

10. A varistor fuse element, comprising:

an electrically insulting cylindrical fuse body having a first end and a second end opposite the first end, wherein the fuse body defines a longitudinal passage extending from the first end to the second end;

a electrically conductive first fuse contact located on the first end of the fuse body;

a electrically conductive second fuse contact located on the second end of the fuse body;

a cylindrical voltage-dependent-resistance varistor body located in the longitudinal passage and including an external surface and an internal surface;

an electrically conductive first varistor electrode located on the external surface of the varistor body and electrically connected to the first fuse contact;

an electrically conductive second varistor electrode located on the internal surface of the varistor body;

an electrically conductive melting member connecting the second fuse contact and the second varistor electrode in order to connect the first fuse contact and the second fuse contact, wherein the melting member includes a portion that is operable to melt and interrupt the connection between the first contact and the second fuse contact when the fuse is electrically overloaded; and an arc extinguishing material located in the longitudinal passage adjacent the melting member.

11. The varistor fuse element of claim 10, wherein the weak portion of the melting member comprises a pre-determined transversal cross-section.

12. The varistor fuse element of claim 11, wherein a solder electrically connects the melting member to second varistor electrode.

13. The varistor fuse element of claim 12, wherein the weak portion of the melting member is located adjacent to the solder.

14. The varistor fuse element of 13, wherein the second varistor electrode is connected to the melting member by the solder until the solder melts.

15. The varistor fuse element of claim 14, wherein the melting member is pre-tensioned prior to connection to second varistor electrode by the solder such that the melting member is operable to deflect away from the second varistor electrode when the solder melts.

16. The varistor fuse element of claim 12, wherein the melting temperature of the solder is lower than a melting temperature of the melting member and a melting temperature of the second varistor electrode.

17. The varistor fuse element of claim 12, wherein the solder includes a resistance that increases in response to increasing temperature.

18. The varistor fuse element of claim 11, wherein the arc extinguishing material includes silica.

* * * * *